US012577639B2

(12) United States Patent
Kuruma et al.

(10) Patent No.: US 12,577,639 B2
(45) Date of Patent: Mar. 17, 2026

(54) ZINC FOIL AND METHOD FOR PRODUCING THE SAME

(71) Applicant: MITSUI KINZOKU COMPANY, LIMITED, Tokyo (JP)

(72) Inventors: Takuya Kuruma, Takehara (JP); Hiroki Sawamoto, Yamaguchi (JP); Hidetoshi Inoue, Takehara (JP)

(73) Assignee: MITSUI KINZOKU COMPANY, LIMITED

( * ) Notice: Subject to any disclaimer, the term of this patent is extended or adjusted under 35 U.S.C. 154(b) by 19 days.

(21) Appl. No.: 18/294,935

(22) PCT Filed: Aug. 1, 2023

(86) PCT No.: PCT/JP2023/028201
§ 371 (c)(1),
(2) Date: Feb. 2, 2024

(87) PCT Pub. No.: WO2024/189937
PCT Pub. Date: Sep. 19, 2024

(65) Prior Publication Data

US 2025/0122596 A1 Apr. 17, 2025

(30) Foreign Application Priority Data

Mar. 13, 2023 (JP) ..... 2023-038724

(51) Int. Cl.
*C22C 18/00* (2006.01)
*C25D 3/22* (2006.01)
*C25D 7/06* (2006.01)

(52) U.S. Cl.
CPC ..... *C22C 18/00* (2013.01); *C25D 3/22* (2013.01); *C25D 7/0614* (2013.01)

(58) Field of Classification Search
None
See application file for complete search history.

(56) References Cited

U.S. PATENT DOCUMENTS

2005/0189231 A1* 9/2005 Capper ..... C25D 3/565 420/513
2011/0250455 A1* 10/2011 Gordon ..... H01J 9/395 428/407

(Continued)

FOREIGN PATENT DOCUMENTS

CN 113871624 A 12/2021
CN 114243019 A 3/2022

(Continued)

OTHER PUBLICATIONS

International Search Report issued in the corresponding International Patent Application No. PCT/JP2023/028201; mailed on Oct. 17, 2023 (total 5 pages).

*Primary Examiner* — Xiaobei Wang
(74) *Attorney, Agent, or Firm* — Harness, Dickey & Pierce, P.L.C.

(57) ABSTRACT

Provided is a zinc foil including a core portion containing zinc as a base metal and containing substantially no bismuth and a cladding portion located on at least one side of the core portion and containing zinc as a base metal and containing bismuth, wherein the core portion and the cladding portion are inseparably bonded to each other. It is preferable that the average zinc crystal grain size in the core portion is larger than the average zinc crystal grain size in the cladding portion. It is also preferable that the average zinc crystal grain size in the cladding portion is 0.2 μm or more and less than 24 μm.

15 Claims, 3 Drawing Sheets

(56) References Cited

U.S. PATENT DOCUMENTS

| | | | | |
|---|---|---|---|---|
| 2012/0061250 | A1* | 3/2012 | Ahmed | H01L 21/02628 205/310 |
| 2013/0302635 | A1* | 11/2013 | Obata | C23C 28/321 428/658 |
| 2020/0032410 | A1 | 1/2020 | Iimori et al. | |
| 2022/0037654 | A1 | 2/2022 | Kamada et al. | |
| 2023/0125587 | A1* | 4/2023 | Sawamoto | H01M 4/38 429/229 |

FOREIGN PATENT DOCUMENTS

| | | | | |
|---|---|---|---|---|
| JP | S55-21817 | A | 2/1980 | |
| JP | H09-161740 | A | 6/1997 | |
| JP | 2007-525598 | A | 9/2007 | |
| JP | 2022-117514 | A | 8/2022 | |
| WO | 2018-190202 | A1 | 10/2018 | |
| WO | WO-2022014720 | A1 * | 1/2022 | C23C 18/52 |

* cited by examiner

ZINC FOIL AND METHOD FOR PRODUCING THE SAME

CROSS REFERENCE TO RELATED APPLICATIONS

This application is a 371 U.S. National Phase of International Application No. PCT/JP2023/028201, filed on Aug. 1, 2023, which claims priority to Japanese Patent Application No. 2023-038724, filed Mar. 13, 2023. The entire disclosures of the above applications are incorporated herein by reference.

BACKGROUND

Technical Field

The present invention relates to a zinc foil and a method for producing the same.

Related Art

The applicant of the present invention has previously proposed a zinc foil containing bismuth, with the remainder consisting of zinc and unavoidable impurities, wherein the zinc foil has a zinc crystal grain size of 0.2 μm or more and 8 μm or less (see US 2022/0037654A1). This zinc foil has the advantage that when the zinc foil is used as a negative electrode active material in a battery, the amount of gas generated during long-term storage of the battery is suppressed, compared with when a conventional rolled zinc foil is used.

JP H9-161740A discloses an alkaline button battery including a negative electrode cup, wherein a negative electrode material mixture side of the negative electrode cup is covered with a metal foil.

In recent years, flexible batteries have been in increasing demand. Flexible batteries tend to be subjected to a load such as a tensile load, and when a zinc foil is used as a negative electrode active material, the foil is likely to fracture. In addition, under such a load, the foil fractures and/or a nascent surface is exposed, which is likely to result in an increase in the amount of gas generated from the zinc foil during long-term storage in an electrolyte solution. For these reasons, there is a need for a zinc foil that can suppress the amount of gas generated during long-term storage even in an environment in which it is likely to be subjected to a load such as a tensile load, and that does not easily fracture under a load such as a tensile load and is therefore very easy to handle. In this respect, the zinc foil disclosed in US 2022/0037654A1 has room for improvement in terms of elongation properties. Also, JP H9-161740A does not take into consideration the issue of achieving both the suppression of gas generation and the improvement of elongation properties.

Accordingly, it is an object of the present invention to provide a zinc foil with which it is possible to overcome various problems encountered with the conventional techniques described above, and a method for producing the zinc foil.

SUMMARY

As a result of in-depth research, the inventors of the present invention found that it is possible to address the above-described problems by combining two specific types of layers containing zinc as a base metal.

The present invention was accomplished based on the above findings, and provides a zinc foil including: a core portion containing zinc as a base metal and containing substantially no bismuth; and a cladding portion located on at least one side of the core portion and containing zinc as a base metal and containing bismuth, wherein the core portion and the cladding portion are inseparably bonded to each other.

Also, the present invention provides a method for producing a zinc foil, the method including: forming a layer containing zinc as a base metal and containing bismuth on at least one side of a rolled zinc foil by employing with a thin-film forming means, the rolled zinc foil containing zinc as a base metal and containing substantially no bismuth.

DETAILED DESCRIPTION

Figure 1:
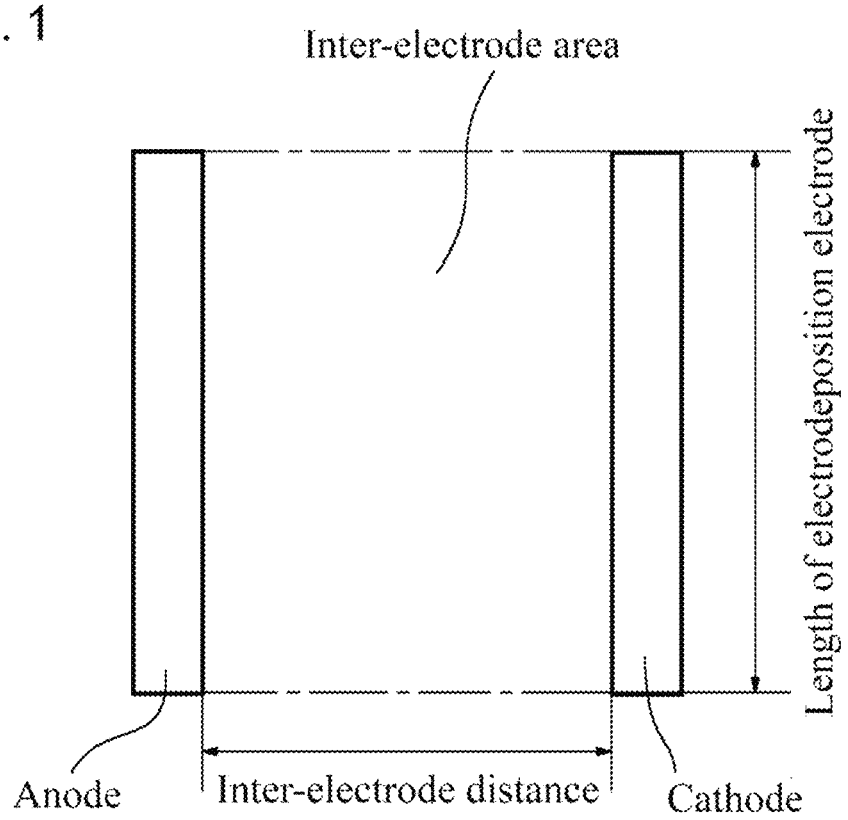
FIG. 1 is a schematic diagram showing an inter-electrode area that is used to calculate a circulation rate of an electrolyte solution.

Hereinafter, a preferred embodiment of the present invention will be described.

A zinc foil of the present invention has a core portion and a cladding portion located on at least one side of the core portion. The core portion and the cladding portion will be individually described below.

In the present embodiment, the core portion is a portion that occupies most of the zinc foil. As with the zinc foil, the core portion is in foil form. In other words, the core portion preferably has a planar shape. A planar shape refers to a flat shape that is thin and wide. This shape may also be referred to as a film-like shape, a sheet-like shape, or a lamellar shape. It is preferable that the core portion is located in the center of the zinc foil with respect to a thickness direction thereof. In other words, it is preferable that the core portion is included in the zinc foil at a central location in the zinc foil with respect to the thickness direction. For example, even when the cladding portion is formed on only one side of the core portion, the zinc foil normally has the above-described configuration if the core portion is thicker than the cladding portion. In addition, the core portion may be exposed on one side of the zinc foil.

The zinc foil contains zinc as a base metal. "Containing zinc as a base metal" means that the percentage content of the zinc element is preferably 80 mass % or more. In order to improve the elongation properties of the zinc foil, it is preferable to use a rolled zinc foil as the core portion. The zinc content in the core portion may be 90 mass % or more, 95 mass % or more, 99 mass % or more, or 99.5 mass % or more.

The core portion contains substantially no bismuth. As a result of the cladding portion, which will be described later, containing bismuth and the core portion containing substantially no bismuth, the core portion can be configured to have good elongation properties, and the presence of the cladding portion makes it possible to suppress gas generation.

The core portion "containing substantially no bismuth" means that the bismuth content in the core portion is 10 ppm by mass or less. The bismuth content in the core portion is preferably 7 ppm or less, more preferably 3 ppm or less, and preferably 0 ppm. The content ratio of the bismuth element can be measured using ICP emission spectroscopy.

Preferably, the core portion consists of zinc, an additive element, and unavoidable impurities, or zinc and unavoidable impurities.

As the additive element in the core portion, it is advantageous to use an element with a hydrogen overvoltage higher than that of zinc or an oxidation-reduction potential nobler than that of zinc. Such a metal element may be at least one selected from the group consisting of indium, magnesium, calcium, gallium, tin, barium, strontium, silver, and manganese.

The unavoidable impurities in the core portion may be iron, copper, tin, aluminum, lead, cadmium, nickel, and chromium. The amount of unavoidable impurities mentioned above, in terms of the ratio of the total of iron, copper, tin, aluminum, lead, cadmium, nickel, and chromium, in the core portion is preferably 100 ppm by mass or less, and more preferably 10 ppm by mass or less.

The content ratios of zinc and the above-listed unavoidable impurities in the core portion are measured by sampling the core portion from the zinc foil and subjecting the sample to ICP emission spectroscopy. The sample is dissolved in an acidic solution such as hydrochloric acid. After that, the concentrations of metal elements other than zinc contained in the zinc foil are measured using ICP emission spectroscopy, and the concentrations are converted into the content ratios by mass of the various metal elements, with the total metal concentration in the solution being set to 1. The method for sampling the core portion is as follows. The position of the core portion is confirmed through observation under a scanning electron microscope, which will be described later. When a cladding portion is located on only one side of the core portion, the surface of the core portion on the core portion side can be scraped off with a cutter, a file, or the like to obtain a sample. On the other hand, when cladding portions are located on two sides of the core portion, a sample consisting of the core portion can be obtained after removing a cladding portion using a cutter, a file, or the like.

From the viewpoints of obtaining a zinc foil with excellent elongation properties and improving flexibility the zinc foil against repeated deformation such as bending, the core portion preferably has an average zinc crystal grain size Sr of 24 μm or more, more preferably 30 μm or more, and even more preferably 35 μm or more. Also, it is preferable that the average zinc crystal grain size Sr in the core portion is 100 μm or less.

From these viewpoints, it is preferable that the average zinc crystal grain size Sr in the core portion is in the range of 24 μm or more and 100 μm or less, more preferably 30 μm or more and 100 μm or less, and even more preferably 35 μm or more and 50 μm or less.

In order to form crystal grains of such size in the core portion, it is preferable to produce the core portion using a rolling method. It should be noted that the average crystal grain size is a concept different from the crystallite size determined from an XRD pattern. The method for measuring the average crystal grain size will be described later.

From the viewpoint of obtaining excellent elongation properties, the core portion preferably has a thickness Wr of 50 μm or more, more preferably 70 μm or more, and even more preferably 100 μm or more. On the other hand, from the viewpoint of flexibility, the thickness Wr of the core portion is preferably 300 μm or less, more preferably 200 μm or less, and even more preferably 150 μm or less. From these viewpoints, the thickness Wr of the core portion is preferably in the range of 50 μm or more and 300 μm or less, more preferably 70 μm or more and 200 μm or less, and even more preferably 100 μm or more and 150 μm or less.

The cladding portion is located on at least one side of the core portion. The cladding portion may be located on only one of two sides of the core portion, or on both sides of the core portion. In the present embodiment, the cladding portion is a layer stacked on the core portion. In the present embodiment, the cladding portion is formed to be stacked on the core portion while being in direct contact with the core portion. On a side of the core portion where the cladding portion is located, the cladding portion may fully cover that side of the core portion, or may cover a part of that side of the core portion. In addition, it is preferable that the cladding portion is exposed on at least one side of the zinc foil, and the cladding portion may be exposed on both sides of the zinc foil. An example of the exposed state is a state in which the cladding portion constitutes an outermost layer of the zinc foil.

The cladding portion contains zinc as a base metal. "Containing zinc as a base metal" has the same meaning as defined for the core portion, and means that the percentage content of the zinc element is preferably 80 mass % or more. The zinc content in the cladding portion may be 90 mass % or more, 95 mass % or more, 99 mass % or more, or 99.5 mass % or more.

The cladding portion contains bismuth, as a result of which gas generation during storage of the battery can be effectively suppressed even under a load such as a tensile load. The content ratio of bismuth in the cladding portion is preferably 100 ppm by mass or more, because this makes it possible to improve the elongation properties and also effectively suppress the amount of gas generated during long-term storage even under a load such as a tensile load. The content ratio of bismuth in the cladding portion is more preferably 300 ppm or more, even more preferably 400 ppm or more, and particularly preferably 500 ppm or more.

On the other hand, the content ratio of bismuth in the cladding portion is preferably 10,000 ppm by mass or less, because this is advantageous for uniform dispersion in the cladding portion. The content ratio of bismuth in the cladding portion is more preferably 3,000 ppm or less, and even more preferably 1,200 ppm or less. From these viewpoints, it is preferable that the content ratio of bismuth in the cladding portion is in the range of 100 ppm by mass or more and 10,000 ppm by mass or less, more preferably 300 ppm by mass or more and 3,000 ppm by mass or less, even more preferably 400 ppm by mass or more and 1,200 ppm by mass or less, and particularly preferably 500 ppm by mass or more and 1,200 ppm by mass or less.

Although the state of bismuth present in the cladding portion is unknown, the inventors of the present invention consider that bismuth is present at least not in a solid solution state in which bismuth forms a solid solution with zinc. The "solid solution state" means a state in which the crystal structure of zinc changes in response to the addition of a metal element. When elemental mapping is performed on a cross section of a zinc foil containing bismuth through energy-dispersive X-ray spectroscopy (a characteristic X-ray detection method) using a scanning electron microscope, a mapping image that shows a state in which zinc is present alone as a metal element and a mapping image that shows a state in which bismuth is present as a metal element can be obtained.

Preferably, the cladding portion consists of zinc, bismuth, an additive element other than bismuth, and unavoidable impurities, or zinc, bismuth, and unavoidable impurities. The cladding portion may or may not be an alloy.

In the case where the cladding portion contains an additive element other than bismuth, it is advantageous to use, as the additive element, an element with a hydrogen overvoltage higher than that of zinc or an oxidation-reduction potential nobler than that of zinc. Such a metal element may be at least one selected from the group consisting of indium, magnesium, calcium, gallium, tin, barium, strontium, silver, and manganese. The amount of the above-described additive element, in terms of the ratio of the total of indium, magnesium, calcium, gallium, tin, barium, strontium, silver, and manganese, in the cladding portion is preferably 10,000 ppm by mass or less, and more preferably 8,000 ppm by mass or less. Furthermore, when the cladding portion contains an additive element selected from indium, magnesium, calcium, gallium, tin, barium, strontium, silver, and manganese, the total amount of the contained additive element(s) may preferably be 10 ppm by mass or more.

The unavoidable impurities in the cladding portion may be iron, copper, tin, aluminum, lead, cadmium, nickel, chromium, sodium, calcium, magnesium, and potassium. The amount of unavoidable impurities mentioned above, in terms of the ratio of the total of iron, copper, tin, aluminum, lead, cadmium, nickel, chromium, sodium, calcium, magnesium, and potassium, in the cladding portion is preferably 100 ppm by mass or less, and more preferably 10 ppm by mass or less.

The content ratios of zinc, the above-listed additive elements, and the above-listed unavoidable impurities in the cladding portion are measured by sampling the cladding portion from the zinc foil and subjecting the sample to ICP emission spectroscopy. The method for subjecting the sample to ICP emission spectroscopy is as described above for the core portion. The method for sampling the cladding portion is as follows. The position of the cladding portion is confirmed through observation under a scanning electron microscope, which will be described later. Then, the surface of a portion of the zinc foil where the cladding portion is exposed can be scraped off with a cutter, a file, or the like to obtain a sample.

It is preferable that the cladding portion has a smaller average zinc crystal grain size than the core portion. This is preferable because, when compared with a conventional zinc foil, the elongation properties can be improved, and also gas generation during storage of the battery can be effectively suppressed. As described above, a large average zinc crystal grain size in the core portion improves the elongation properties of the zinc foil. On the other hand, the cladding portion in which relatively small zinc crystal grains are distributed, creating a state in which a large number of grain boundaries are present, can reduce the amount of gas generated during storage even after the zinc foil has been subjected to a load such as a tensile load.

From the viewpoint of making the advantage of reducing the amount of gas generated during storage even after the zinc foil has been subjected to a load such as a tensile load more marked, the cladding portion preferably has an average zinc crystal grain size Sd of less than 24 μm, more preferably 20 μm or less, and even more preferably 10 μm or less. In addition, from the viewpoint of making the advantage of reducing the amount of gas generated during storage even after the zinc foil has been subjected to a load such as a tensile load more marked, the average zinc crystal grain size Sd in the cladding portion is preferably 0.2 μm or more, more preferably 1 μm or more, and even more preferably 2 μm or more. Based on the foregoing, it is preferable that the average zinc crystal grain size Sd in the cladding portion is in the range of 0.2 μm or more and less than 24 μm, more preferably 1 μm or more and 20 μm or less, and even more preferably 2 μm or more and 10 μm or less. In order to form crystal grains of such size in the cladding portion, it is preferable to produce the cladding portion using an electrolytic method.

When the average zinc crystal grain size in the core portion is Sr, and the average zinc crystal grain size in the cladding portion is Sd, Sd/Sr is preferably 1 or less, because this can markedly achieve the effect of enabling the suppression of gas generation during storage of the battery while improving the elongation properties. Sd/Sr is more preferably 0.5 or less, and even more preferably 0.3 or less.

The average zinc crystal grain size is measured using a method described below. For the measurement, an FE gun scanning electron microscope (SUPRA 55VP available from Carl Zeiss Co., Ltd.) equipped with an electron backscatter diffraction (hereinafter also referred to as "EBSD") evaluation apparatus (OIM Data Collection Ver. 7.2.0 available from TSL solutions), and an attached EBSD analysis apparatus are used. A sample is prepared by cutting out a section of a zinc foil using an ultramicrotome, and data regarding the crystal grain size of this sample in a cross-sectional view in which the total thickness of the sample can be measured is obtained in accordance with an EBSD method.

Figure 2:
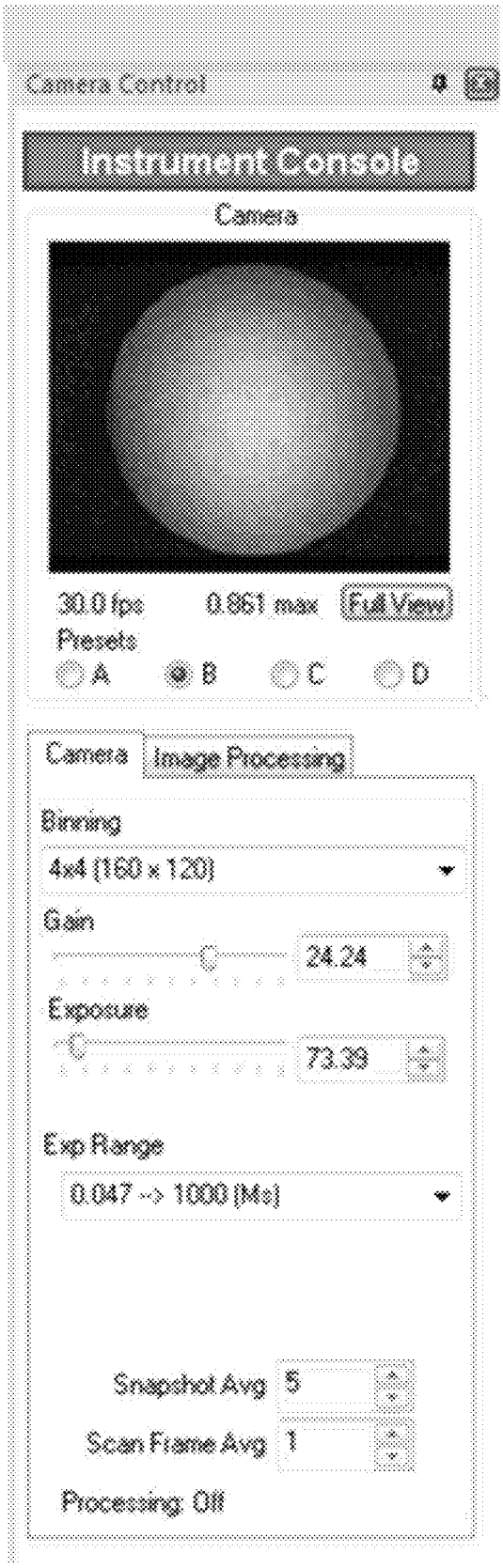
FIG. 2 is a captured image of software that is used to determine a zinc crystal grain size.

Background processing of EBSD measurement data is performed by, in the above-mentioned EBSD evaluation apparatus, unchecking the checkboxes "Background Subtraction", "Normalize Intensity Histogram", and "Dynamic Background Subtraction" under the "Image Processing" tab, and setting "Binning" to 4×4 (160×120). "Gain" and "Exposure" may be changed as appropriate such that, in an image shown in the "Camera" window, as shown in FIG. 2, a Kikuchi pattern is not observed with electron diffraction and 30±1 fps is satisfied. Under this condition, the value of "Ave" under the "Image Processing Function" tab is set to 10, and background information is acquired by clicking "Capture Bkd".

The value of WD during the crystal grain size measurement is set to 15±1 mm, and the checkboxes "Background Subtraction", "Normalize Intensity Histogram", and "Dynamic Background Subtraction" under the "Image Processing" tab are checked. In an observation area, "Zn" is selected from "Phase" under "Capture Pattern" in the EBSD evaluation apparatus, and the value of WD is adjusted under the condition in which the value of "Fit" under "Solutions" is 1.5 or less and the value of "CI" is greater than 0.1.

The crystal grain size is measured by obtaining a cross-sectional image of the sample by clicking "Capture SEM" under "Scan", and then clicking "Start Scan".

From the measurement data, the crystal grain size (average) (Grain Size (Average)) is determined using "All data" in "Grain Size Quick Chart" under the analysis menu in EBSD analysis program (OIM Analysis Ver. 7.3.1 available from TSL solutions).

The obtained crystal grain size (average) is used as the average zinc crystal grain size in the present invention.

In this measurement, boundaries with a misorientation of 15° or more are regarded as being grain boundaries. However, since zinc has a hexagonal close-packed crystal structure, taking twin boundaries into consideration, the misorientation angle of a grain boundary is expressed using a rotation axis and a rotation angle, and if the rotation axis is represented by (1) given below and the rotation angle is 94.8±1° and 57±1°, or if the rotation axis is represented by (2) given below and the rotation angle is 34.8±1° and 64.3±1°, the grain boundary is not regarded as being a grain boundary. The conditions of the scanning electron microscope during observation are set as follows: an acceleration voltage of 20 kV, an aperture diameter of 60 μm, High Current mode, and a sample angle of 70°. The observation magnification, the measurement area, and the step size may be changed as appropriate according to the crystal grain size.

[Math. 1]

$$\langle \bar{1}\,2\,\bar{1}\,0 \rangle \quad (1)$$

$$\langle \bar{1}\,1\,0\,0 \rangle \quad (2)$$

As described above, in the core portion and the cladding portion, it is preferable that the core portion has a larger average crystal grain size than the cladding portion, but in the cladding portion, the average crystal grain size may increase continuously or discontinuously toward the core portion in the thickness direction.

From the viewpoint of suppressing gas generation under a load such as a tensile load, the cladding portion preferably has a thickness Wd of 1 μm or more, more preferably 10 μm or more, and even more preferably 20 μm or more. The thickness Wd of the cladding portion is preferably less than 200 μm, more preferably 100 μm or less, and even more preferably 50 μm or less. Based on the foregoing, the thickness Wd of the cladding portion is preferably in the range of 1 μm or more and less than 200 μm, more preferably 10 μm or more and 100 μm or less, and even more preferably 20 μm or more and 50 μm or less.

In the case where cladding portions are disposed on both sides of the core portion respectively, the sum of the thicknesses of the two cladding portions on the two sides is used as the thickness of the cladding portion.

When the thickness of the core portion is Wr, and the thickness of the cladding portion is Wd, Wd/Wr is preferably 1 or less, because this makes the effect of improving the elongation properties marked. Wd/Wr is more preferably 0.8 or less, and particularly preferably 0.5 or less. From the viewpoint of making the gas generation suppressing effect marked, Wd/Wr is preferably 0.1 or more, more preferably 0.2 or more, and even more preferably 0.3 or more. Based on the foregoing, from the viewpoint of achieving both excellent elongation properties and an excellent gas generation suppressing effect, Wd/Wr is preferably 0.1 or more and 1 or less, more preferably 0.2 or more and 0.8 or less, and even more preferably 0.3 or more and 0.5 or less.

Figure 3:
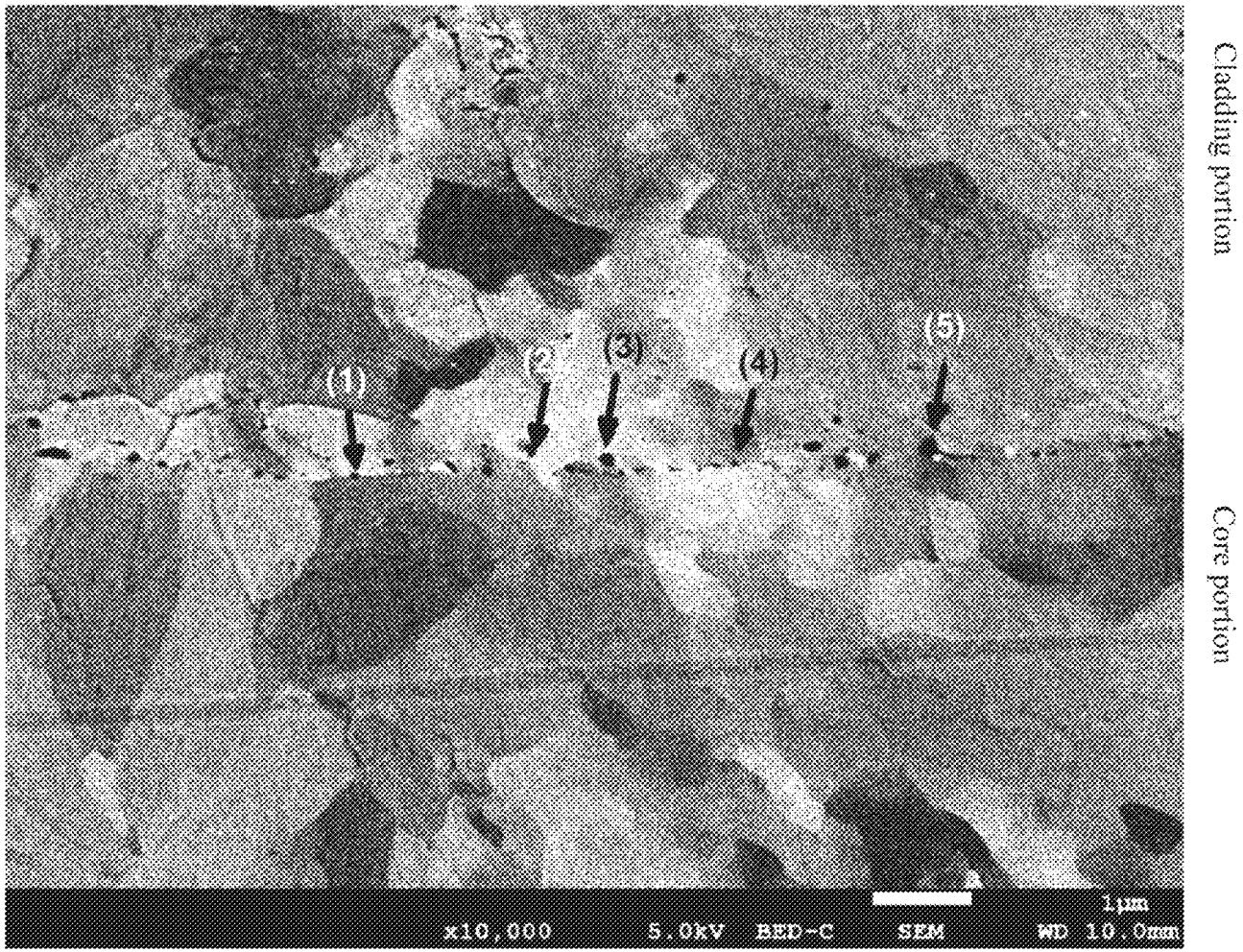
FIG. 3 is a scanning electron microscope image along a cross section in a thickness direction of a zinc foil obtained in Example 1.

The core portion is inseparably bonded to the cladding portion. The core portion being inseparably bonded to the cladding portion means that when a cross section of the zinc foil taken along the thickness direction is observed using a scanning electron microscope, at least one crystal grain having a shape that straddles the interface between the core portion and the cladding portion is observed. This shape forms as a result of a crystal grain in the cladding portion growing in such a manner as to align the orientation plane of a crystal grain in the core portion. More specifically, in a cross section of the zinc foil of the present embodiment taken along the thickness direction, a row of pore portions constituted by a plurality of small pore portions indicated by the arrows in FIG. 3 is observed at the interface between the core portion and the cladding portion, and the position of the interface can be identified by this row of pore portions. As shown in FIG. 3, when the scanning electron microscope image is a backscattered electron image, individual zinc crystal grains in the microscope image have different shades of color, reflecting the different orientation planes of the crystal grains. The shapes of the zinc crystal grains can be identified based on the differences between shades. For example, a white crystal grain having a shape that straddles the interface between the core portion and the cladding portion is observed between the pores indicated by the second and third arrows (2) and (3) from the left in FIG. 3. Similarly, a white crystal grain having a shape that straddles the interface between the core portion and the cladding portion is also observed between the pores indicated by the third and fourth arrows (3) and (4) from the left in FIG. 3. If at least one crystal grain having a continuous shape that extends across the interface between the core portion and the cladding portion is observed as described above, the core portion and the cladding portion can be judged to be inseparably bonded to each other, and it is preferred that two or more such crystal grains are observed. It should be noted that the interface between the core portion and the cladding portion can also be confirmed by checking the location of bismuth through EDS analysis (energy-dispersive spectroscopy).

The zinc foil desirably contains no aluminum from the viewpoint of reducing negative effects such as passivation in a primary battery or a secondary battery. In addition, the zinc foil desirably contains no lead from the viewpoint of reducing environmental burden. The zinc foil may contain a trace amount of aluminum and/or lead as unavoidable impurities, but even if the zinc foil contains one or both of these elements, the content ratio thereof is desirably as low as possible. Specifically, the content ratio of aluminum is preferably 1% or less, more preferably 0.1% or less, and even more preferably 0.05% or less, with respect to the mass of the zinc foil. The content ratio of lead is preferably 200 ppm or less, more preferably 100 ppm or less, and even more preferably 50 ppm or less, with respect to the mass of the zinc foil. In addition, the zinc foil contains no cadmium or may contain cadmium as unavoidable impurities. The content ratio of cadmium in the zinc foil is desirably as low as possible. In particular, the content ratio of cadmium is desirably 10 ppm by mass or less. The content ratios of aluminum, lead, and cadmium in the zinc foil are measured through ICP emission spectroscopy. For measurement through ICP emission spectroscopy, a similar method to that described above can be used.

The zinc foil of the present invention is a thin zinc foil with a thickness of preferably 10 μm or more and 500 μm or less, more preferably 15 μm or more and 400 μm or less, and even more preferably 20 μm or more and 300 μm or less. The thickness of the zinc foil is measured using the above-described method. Such a thin zinc foil is particularly suitable as a negative electrode material for thin primary batteries and secondary batteries. In particular, when the zinc foil of the present invention is formed by the core portion and the cladding portion described above, the zinc foil has enhanced flexibility due to this configuration in which the zinc foil is formed by the core portion and the cladding portion, and thus, the occurrence of cracks and wrinkles is suppressed even though the zinc foil is thin.

Next, a preferred method for producing a zinc foil of the present invention will be described.

In the present production method, by employing a thin-film forming means, a layer containing zinc as a base metal and containing bismuth is formed on at least one side of a rolled zinc foil containing zinc as a base metal and containing substantially no bismuth. In the present production method, it is preferable that the layer containing zinc as a base metal and containing bismuth is formed by performing electrolytic plating on at least one side of the rolled zinc foil using the rolled zinc foil as a cathode and using an electrolyte solution containing zinc ions and bismuth ions.

To produce the rolled zinc foil, for example, when a core portion having a thickness of 100 to 150 μm is to be obtained, a method may be adopted in which a zinc plate having a thickness of 200 to 300 μm is rolled into a zinc foil using a rolling means such as a rolling roll. When a core portion having a thickness of less than 100 μm or a thickness of more than 150 μm is to be obtained as well, the rolled zinc foil can be produced in conformity with the above-described method. As the method for producing the zinc plate, a method may be adopted in which zinc is melted at 500° C. to 600° C., and the molten metal is casted into a mold to obtain a cast. The average crystal grain size of the rolled zinc foil can be controlled by adjusting the temperature conditions during rolling and conditions such as the cooling rate during subsequent steps.

As the method for forming the zinc-containing layer on at least one side of the rolled zinc foil using a thin-film forming means, either a method (1) or a method (2) below may be adopted. In this manner, a zinc foil can be obtained in which a core portion that is formed by a rolled zinc foil and a cladding portion are inseparably bonded to each other and which takes advantage of the elongation properties of the rolled zinc foil while effectively suppressing gas generation.

(1) The zinc-containing layer is formed by performing electrolytic plating on at least one side of the rolled zinc foil using the rolled zinc foil as a cathode and using an electrolyte solution containing zinc ions.

(2) The zinc-containing layer is formed on at least one side of the rolled zinc foil using a physical vapor deposition method or a chemical vapor deposition method.

Now, the method (1) will be described.

In the electrolytic method, an anode and a cathode are immersed in an electrolyte solution containing a zinc source, and electrolytic zinc is deposited on the rolled zinc foil, which is used as the cathode. As the electrolyte solution containing a zinc source, an aqueous zinc sulfate solution, an aqueous zinc nitrate solution, an aqueous zinc chloride solution, or the like may be used. The zinc concentration in the electrolyte solution is preferably 30 g/L or more and 100 g/L or less, because this makes it possible to easily obtain a cladding portion with a small average crystal grain size. As the anode that is used in electrolysis, a known dimensionally-stable electrode (DSE) is preferably used. As the DSE, for example, a titanium electrode coated with iridium oxide, a titanium electrode coated with ruthenium oxide, or the like is preferably used.

The electrolyte solution also contains a bismuth source in addition to the zinc source. The concentration of the bismuth source in the electrolyte solution is set such that the ratio of the mass of bismuth to the total mass of zinc and bismuth in the electrolyte solution is preferably 10 ppm or more and 10,000 ppm or less, more preferably 15 ppm or more and 8,000 ppm or less, even more preferably 20 ppm or more and 7,000 ppm or less, and yet even more preferably 30 ppm or more and 6,500 ppm or less.

The electrolyte solution may further contain an additional compound. As the additional compound, for example, sulfuric acid may be added for the purpose of adjusting the pH of the electrolyte solution.

From the viewpoint of successfully obtaining a zinc foil that suppresses the amount of gas generation, it is advantageous to circulate the electrolyte solution during electrolysis. In order to circulate the electrolyte solution, for example, an electrolysis apparatus that includes a closed flow path, an electrolytic bath provided in the flow path, and a pump provided in the flow path can be used, and the electrolyte solution can be made to unidirectionally flow through the electrolytic bath by driving the pump. The anode and the cathode that are used in electrolysis can be immersed in the electrolytic bath, with the anode and the cathode being opposed to each other. It is preferable that the anode and the cathode are disposed in the electrolytic bath such that the opposing surfaces of the anode and the cathode (i.e., the electrodeposition surface in the case of the cathode) are parallel to the flow direction of the electrolyte solution.

When performing electrolysis while circulating the electrolyte solution, it is advantageous to adjust the flow rate of the electrolyte solution, or in other words, the circulation rate of the electrolyte solution, because this makes it possible to successfully obtain a zinc foil that achieves the desired effects. More specifically, the circulation rate of the electrolyte solution is preferably set to 0.001 L/(min·mm$^2$) or more and 1 L/(min·mm$^2$) or less, more preferably 0.0015 L/(min·mm$^2$) or more and 0.6 L/(min·mm$^2$) or less, even more preferably 0.002 L/(min·mm$^2$) or more and 0.4 L/(min·mm$^2$) or less, and yet even more preferably 0.0029 L/(min·mm$^2$) or more and 0.04 L/(min·mm$^2$) or less. The circulation rate is calculated by dividing the flow rate (L/min) of the electrolyte solution by the inter-electrode area (mm$^2$). As shown in FIG. 1, the inter-electrode area is expressed as the product of the inter-electrode distance (mm) and the width (mm) of the electrodeposition electrode. In FIG. 1, the electrolyte solution is preferably made to flow in a direction orthogonal to the paper plane. Also, in FIG. 1, the plate-like electrodes extend in the direction orthogonal to the paper plane.

The current density during electrolysis is one of the factors that affect the zinc crystal grain size in the zinc foil to be obtained and the amount of gas to be generated from the zinc foil. Specifically, by setting the current density to a value larger than that used in an ordinary zinc electrolysis condition, it is possible to generate a large number of fine crystals and to thereby easily obtain a zinc foil with a small average crystal grain size. In view of this, the current density is preferably set to 1,000 A/m$^2$ or more and 10,000 A/m$^2$ or less, more preferably 1,000 A/m$^2$ or more and 6,000 A/m$^2$ or less, and even more preferably 1,000 A/m$^2$ or more and 4,000 A/m$^2$ or less.

The electrolyte solution can be subjected to electrolysis in a non-heated state or a heated state. In the case where electrolysis is performed with the electrolyte solution being heated, the temperature of the electrolyte solution is preferably set to 10° C. or more and 90° C. or less. The temperature of the electrolyte solution is more preferably 20° C. or more and 90° C. or less, even more preferably 30° C. or more and 80° C. or less, and yet even more preferably 30° C. or more and 70° C. or less. Electrolysis is performed until the thickness of the zinc foil reaches an intended value.

Furthermore, the present invention can also provide a method for producing a zinc foil, the method including:

forming a first electrolytic zinc layer by performing a first electrolytic plating process on one side of a cathode using a first electrolyte solution in which the above-described electrolyte solution contains zinc ions; and forming a second electrolytic zinc layer by performing a second electrolytic plating process on another side of the cathode using a second electrolyte solution containing zinc ions.

In the first electrolytic plating process and the second electrolytic plating process, the composition of the plating solution, the current density, and the like may be the same or different.

Next, the method (2) will be described. The zinc-containing layer is formed on at least one side of the rolled zinc foil using a physical vapor deposition method or a chemical vapor deposition method. As the physical vapor deposition method, vacuum deposition, sputter deposition, ion plating, or the like may be used. As the chemical vapor deposition method, plasma-enhanced chemical vapor deposition, low-temperature plasma-enhanced chemical vapor deposition, thermal chemical vapor deposition, photochemical vapor deposition, or the like may be used. Of these methods, sputter deposition is preferably used in terms of preventing gas generation.

The thus obtained zinc foil of the present invention is suitably used as the material of a negative electrode active material for a primary battery or a secondary battery. An example of the primary battery is a manganese battery. Examples of the secondary battery include a nickel-zinc battery, an air-zinc battery, and a manganese-zinc battery. In particular, the zinc foil battery of the present invention is suitably used as the material of a negative electrode active material for a primary battery. Furthermore, since the zinc foil itself is conductive, the zinc foil also functions as a current collector. Thus, it is also possible to use the zinc foil itself as a negative electrode without the need to use a current collector. When using a zinc foil in which the cladding portion is located on only one side of the core portion as a negative electrode, it is preferable to dispose the zinc foil such that the side on which the cladding portion is provided comes into contact with an electrolyte solution.

The zinc foil of the present invention has a configuration in which a specific cladding portion and a specific core portion are inseparably bonded to each other as described above, and therefore, in a battery provided with the zinc foil, the zinc foil can be used as a zinc electrode material that can maintain the amount of gas generation while ensuring the ease of handling (foil elongation), as a result of combining a cladding portion that has a good effect of reducing the amount of gas generation and a more flexible base material into a single body. As shown in Examples, which will be described later, even after applying tension, the amount of gas generated is equivalent to that of a conventional electrolytic zinc foil, and fracturing can also be suppressed. Thus, it is possible to produce a flexible battery with improved flexibility against repeated deformation.

For example, the elongation after fracture, of the zinc foil of the present invention when measured at a tensile speed of 1 mm/min with a distance between chucks of 30 mm and a specimen width of 45 mm is preferably 8% or more, preferably 10% or more, and more preferably 14% or more. Such a zinc foil has good elongation properties and is very easy to handle.

The elongation after fracture can be obtained by determining the percentage elongation after fracture specified in JIS-Z2241(2011) in the following manner using a tensile testing machine.

(Elongation after Fracture)

A tensile testing machine AG100KNE available from Shimadzu Corporation is used. The tensile testing conditions are as follows: the specimen width is as described above, the measurement temperature is 25° C., the tensile speed is 1 mm/min, and the distance between chucks is as described above; end portions of a zinc foil are gripped by chucks (grippers) of a tensile testing machine, the distance between the gripped portions is measured before testing and used as the original gauge length, the zinc foil is then continuously pulled by moving the chucks, and the percentage of the distance that has been traveled by the chucks when the zinc foil fractures relative to the original gauge length is calculated using an equation below and used as the elongation after fracture. The testing is performed with the number of repetitions N=2 (two specimens), and the average value of the two data sets is obtained.

$$\text{Percentage elongation after fracture} = \text{distance between chucks (mm)} / \text{original gauge length (mm)} \times 100$$

The present invention was accomplished based on the above-described findings, and provides <1> to <10> below.

<1> A zinc foil comprising:

a core portion containing zinc as a base metal and containing substantially no bismuth; and a cladding portion located on at least one side of the core portion and containing zinc as a base metal and containing bismuth, wherein the core portion and the cladding portion are inseparably bonded to each other.

<2> The zinc foil as set forth in clause <1>, wherein an average zinc crystal grain size in the core portion is larger than an average zinc crystal grain size in the cladding portion.

<3> The zinc foil as set forth in clause <2>, wherein the average zinc crystal grain size in the cladding portion is 0.2 μm or more and less than 24 μm.

<4> The zinc foil as set forth in clause <2> or <3>, wherein the average zinc crystal grain size in the core portion is 24 μm or more.

<5> The zinc foil as set forth in any one of clauses <1> to <4>, wherein a bismuth content in the cladding portion is 100 ppm or more and 10,000 ppm or less.

<6> The zinc foil as set forth in any one of clauses <1> or <5>, wherein a thickness of the core portion is 50 μm or more and 300 μm or less.

<7> The zinc foil as set forth in any one of clauses <1> to <6>, wherein a thickness of the cladding portion is 1 μm or more and less than 200 μm.

<8> The zinc foil as set forth in any one of clauses <1> to <7>, wherein the zinc foil has an elongation after fracture of 8% or more, wherein the elongation is measured at a tensile speed of 1 mm/min with a distance between chucks of 30 mm and a specimen width of 45 mm.

<9> A method for producing a zinc foil, the method comprising: forming a layer containing zinc as a base metal and containing bismuth on at least one side of a rolled zinc foil by employing with a thin-film forming means, the rolled zinc foil containing zinc as a base metal and containing substantially no bismuth.

<10> The method for producing a zinc foil as set forth in clause <9>, wherein the layer containing zinc as the base metal and containing bismuth is formed by performing electrolytic plating on at least one side of the rolled zinc foil using the rolled zinc foil as a cathode and using an electrolyte solution containing zinc ions and bismuth ions.

EXAMPLES

Hereinafter, the present invention will be described in further detail based on examples. However, the scope of the present invention is not limited to the examples given below. Unless otherwise specified, "%" means "mass %".

Example 1

(1) Provision of Rolled Zinc Foil

A rolled zinc foil (purity: 99.99%, available from Mitsui Sumitomo Metal Mining Brass & Copper Co., Ltd.) having the thickness shown in Table 1 was provided.

(1) Preparation of Electrolyte Solution

Zinc oxide was used as a zinc compound. The zinc compound was dissolved in water together with sulfuric acid to prepare an electrolyte solution. The zinc concentration in the electrolyte solution was set to 50 g/L. The sulfuric acid concentration was set to 200 g/L, as a value obtained by converting the total amount of sulphate ions as $H_2SO_4$. Bismuth nitrate was added to the electrolyte solution. The bismuth concentration was adjusted such that the content ratio of bismuth in the cladding portion was the value shown in Table 1.

(2) Reduction and Deposition of Zinc

As an anode, a DSE composed of a titanium electrode coated with iridium oxide was used. As a cathode, the above-described rolled zinc foil was used. In a state in which the electrolyte solution was heated to 35° C., an electric current was passed between the anode and the cathode. The current density was set to 2,000 A/m$^2$. The electrolyte solution was circulated with the circulation rate being set to 0.029 L/(min·mm$^2$). With one side of the rolled foil masked, the unmasked side of the rolled foil was immersed in the electrolyte solution, and electrolysis was performed to form an electrolytic zinc layer having an electrolytic thickness of 13 μm on one side of the rolled zinc foil. Thus, a zinc foil in which the electrolytic zinc layer and the rolled zinc layer were combined and formed a single body was obtained. In this zinc foil, the rolled zinc layer corresponds to the core portion, and the electrolytic zinc layer corresponds to the cladding portion. The obtained zinc foil was washed with ion-exchanged water and dried with hot air. A cross section taken along the thickness direction of the zinc foil obtained in FIG. 1 was observed using a scanning electron microscope (JSM-7900F available from JEOL Ltd.) at a magnification of 10,000 times (the field of view was 9 μm in the thickness direction of the zinc foil and 12 μm in a direction perpendicular to the thickness direction of the zinc foil). FIG. 3 shows an observed image. The contrast of the observed image in FIG. 3 was adjusted to clearly show shades.

Example 2

The same procedures as in Example 1 were performed, except that thickness of the electrolytic zinc layer was changed to the value shown in Table 1 by changing the electrolysis time in the step (2) of Example 1, and the amount of bismuth nitrate added was also changed so that the amount of bismuth in the zinc layer was changed to the value shown in Table 1.

Example 3

The same procedures as in Example 1 were performed, except that the thickness of the electrolytic zinc layer was changed to the value shown in Table 1 by changing the electrolysis time in the step (2) of Example 1, and the amount of bismuth nitrate added was also changed so that the amount of bismuth in the zinc layer was changed to the value shown in Table 1.

Example 4

The same procedures as in Example 1 were performed, except that the thickness of the electrolytic zinc layer was changed to the value shown in Table 1 by changing the electrolysis time in the step (2) of Example 1, and the amount of bismuth nitrate added was also changed so that the amount of bismuth in the zinc layer was changed to the value shown in Table 1.

Example 5

The same procedures as in Example 1 were performed, except that the thickness of the electrolytic zinc layer was changed to the value shown in Table 1 by changing the electrolysis time in the step (2) of Example 1, and the amount of bismuth nitrate added was also changed so that the amount of bismuth in the zinc layer was changed to the value shown in Table 1.

Example 6

The same procedures as in Example 1 were performed, except that the amount of bismuth nitrate added was changed in the step (2) of Example 2 so that the amount of bismuth in the zinc layer was changed to the value shown in Table 1.

Example 7

The same procedures as in Example 1 were performed, except that the amount of bismuth nitrate added was changed in the step (2) of Example 2 so that the amount of bismuth in the zinc layer was changed to the value shown in Table 1.

Comparative Example 1

The rolled zinc foil used in Example 2 was directly used as the zinc foil in Comparative Example 1.

Comparative Example 2

This comparative example corresponds to US 2022/0037654A1.

As the cathode, an aluminum plate was used. The electrolytic thickness was changed to 100 μm by changing the electrolysis time. The current density was set to 2,000 A/m$^2$. The bismuth concentration was adjusted such that the content ratio of bismuth in the electrolytic layer was the value shown in Table 1. Electrolysis was performed in the same manner as in Example 1, except that the foregoing changes were made, and thus, an electrolytic zinc layer was formed on one side of the aluminum plate. Upon completion of electrolysis, the electrolytic zinc layer was removed from the aluminum plate, which served as the cathode, to obtain a zinc foil. The obtained zinc foil was washed with ion-exchanged water and dried with hot air.

Comparative Example 3

A zinc foil was obtained in the same manner as in Comparative Example 2, except that the thickness of the electrolytic layer in Comparative Example 2 was adjusted. The rolled zinc foil obtained in Comparative Example 1 and the zinc foil obtained as described above were bonded to each other with double-sided adhesive tape.

Comparative Example 4

The rolled zinc foil in Example 1 was changed to a rolled zinc foil (available from Mitsui Sumitomo Metal Mining Brass & Copper Co., Ltd.) having the average crystal grain size shown in Table 1. The thickness of the electrolytic zinc layer was changed to the value shown in Table 1 by changing the electrolysis time, and the amount of bismuth nitrate added was also changed to zero. Otherwise, the same procedures as in Example 1 were performed.

For the zinc foils obtained in the examples and the comparative examples, whether or not the electrolytic zinc layer and the rolled zinc layer were inseparably bonded to each other was checked using the above-described method. In Comparative Example 3, the core portion and the cladding portion were separate from each other, and no crystal grain having a shape straddling the core portion and the cladding portion was observed. In addition, for the zinc foils obtained in the examples and the comparative examples, the average crystal grain sizes in the core portion and the cladding portion were measured using the above-described methods. Specifically, crystal grains in the core portion were observed in a field of view that occupied "200 μm in the thickness direction of the core portion×200 μm in the direction perpendicular to the thickness direction of the core portion" of the core portion in a cross section (cross section taken along the thickness direction) of the entire zinc foil, and the average crystal grain size was obtained. On the other hand, crystal grains in the cladding portion were observed in a field of view that occupied "200 μm in the thickness direction of the cladding portion×200 μm in the direction perpendicular to the thickness direction of the cladding portion" of the cladding portion in the cross section of the entire zinc foil, and the average crystal grain size was obtained.

Furthermore, the zinc foils obtained in the examples and the comparative examples were evaluated in the following manner.

(Elongation after Fracture)

The elongation after fracture was measured using the above-described method.

(Amount of Gas Generated (after Pulling))

A zinc foil was pulled to elongation just before fracture under the above-described tensile testing conditions, and the amount of gas generated from the zinc foil was determined under the following conditions.

A 20% aqueous ammonium chloride solution was used as an electrolyte solution. One side of the zinc foil placed under tension through pulling was immersed in the electrolyte solution and allowed to stand at 70° C. for 96 hours. In the case where the cladding portion was formed on only one side of the core portion, the side on which the cladding portion was formed was immersed (the same applies to testing of "Amount of gas generated (after fracture)" below). The amount of hydrogen gas generated during the period was measured using a glass cell. The measurement result was converted to the amount of gas generated per unit area per day. The testing was performed with the number of repetitions N=1 (two specimens), and the average value of the two data sets was obtained.

(Amount of Gas Generated (after Fracture))

A 20% aqueous ammonium chloride solution was used as an electrolyte solution. A zinc foil that had fractured during the above-described testing of the elongation after fracture was immersed in the electrolyte solution. The zinc foil was allowed to stand at 70° C. for 96 hours in this electrolyte solution. The amount of hydrogen gas generated during the period was measured using a glass cell. The measurement result was converted to the amount of gas generated per unit area per day. The testing was performed with the number of repetitions N=1 (two specimens), and the average value of the two data sets was obtained.

TABLE 1

| | Core portion | | | | Cladding portion | | | |
|---|---|---|---|---|---|---|---|---|
| | Production method | Average crystal grain size Sr [μm] | Thickness Wr [μm] | Metal added Bi [ppm by mass | Production method | Average crystal grain size Sd [μm] | Thickness Wd [μm] | Metal added Bi [ppm by mass |
| Com. Ex. 1 | Rolling | 25 | 100 | — | — | — | — | — |
| Com. Ex. 2 | Electrolysis | 8 | 100 | 700 | — | — | — | — |
| Com. Ex. 3 | Rolling | 25 | 100 | — | Electrolytic foil was bonded to core portion with double-sided adhesive tape | 4 | 30 | 700 |
| Com. Ex. 4 | Rolling | 36 | 100 | — | Electrolysis on core portion | 17 | 30 | — |
| Ex. 1 | Rolling | 30 | 100 | — | Electrolysis on core portion | 6 | 13 | 600 |
| Ex. 2 | Rolling | 25 | 100 | — | Electrolysis on core portion | 10 | 26 | 780 |
| Ex. 3 | Rolling | 37 | 100 | — | Electrolysis on core portion | 16 | 50 | 730 |
| Ex. 4 | Rolling | 34 | 100 | — | Electrolysis on core portion | 15 | 80 | 700 |
| Ex. 5 | Rolling | 24 | 100 | — | Electrolysis on core portion | 6 | 96 | 720 |

TABLE 1-continued

| | | | | | | | | |
|---|---|---|---|---|---|---|---|---|
| Ex. 6 | Rolling | 31 | 100 | — | Electrolysis on core portion | 20 | 30 | 160 |
| Ex. 7 | Rolling | 37 | 100 | — | Electrolysis on core portion | 4 | 30 | 2000 |

| | State of bonding between core portion and cladding portion | Ratio of average crystal grain size (Sd/Sr) | Ratio of thick-ness (Wd/Wr) | Evaluation: Elongation after fracture Average [%] | Evaluation: Amount of gas generated (after pulling) [μl/cm²/d] | Evaluation: Amount of gas generated (after fracture) [μl/cm²/d] |
|---|---|---|---|---|---|---|
| Com. Ex. 1 | — | 0 | 0 | 24 | 1425 | 1833 |
| Com. Ex. 2 | — | 0 | 0 | 7 | 82 | 108 |
| Com. Ex. 3 | Bonded in a separate state | 0.16 | 0.3 | 13 | Not measurable due to layer separation | Not measurable due to layer separation |
| Com. Ex. 4 | Inseparably bonded | 0.47 | 0.3 | 22 | >1500 | >1500 |
| Ex. 1 | | 0.2 | 0.13 | 17 | 85 | 92 |
| Ex. 2 | | 0.4 | 0.26 | 14 | 75 | 85 |
| Ex. 3 | | 0.43 | 0.5 | 17 | 75 | 100 |
| Ex. 4 | | 0.44 | 0.8 | 17 | 58 | 92 |
| Ex. 5 | | 0.25 | 0.96 | 15 | 74 | 167 |
| Ex. 6 | | 0.65 | 0.3 | 20 | 417 | 375 |
| Ex. 7 | | 0.11 | 0.3 | 21 | 142 | 108 |

As shown in Table 1, in each example, the elongation after fracture was excellent, and the amount of gas generated after applying tension was suppressed. In contrast, in Comparative Example 1, in which the rolled zinc foil was used, and Comparative Example 4, in which the cladding portion did not contain bismuth, a large amount of gas was generated. Moreover, the elongation after fracture in Comparative Example 2 was smaller than those in the examples. In Comparative Example 3, in which the core portion and the cladding portion were separate from each other, layer separation occurred during measurement of the amount of gas generated, and the amount of gas generated could not be measured.

INDUSTRIAL APPLICABILITY

According to the present invention, provided is a zinc foil that can suppress the amount of gas generated during long-term storage even in an environment in which the zinc foil is likely to be subjected to a load such as a tensile load, and that has a good elongation after fracture and is very easy to handle.

The invention claimed is:

1. A zinc foil comprising:

a core portion containing zinc as a base metal and containing substantially no bismuth; and a cladding portion located on at least one side of the core portion and containing zinc as a base metal and containing bismuth, wherein the core portion and the cladding portion are inseparably bonded to each other such that, in a cross-section of the zinc foil taken along a thickness direction of the zinc foil by a scanning electron microscope, at least one crystal grain of the cladding portion, having a shape that straddles an interface between the core portion and the cladding portion, is observed, and the cladding portion contains 99 mass % or more of zinc.

2. The zinc foil according to claim 1, wherein an average zinc crystal grain size in the core portion is larger than an average zinc crystal grain size in the cladding portion.

3. The zinc foil according to claim 2, wherein the average zinc crystal grain size in the cladding portion is 0.2 μm or more and less than 24 μm.

4. The zinc foil according to claim 2, wherein the average zinc crystal grain size in the core portion is 24 μm or more and 100 μm or less.

5. The zinc foil according to claim 1, wherein a bismuth content in the cladding portion is 100 ppm or more and 10,000 ppm or less.

6. The zinc foil according to claim 1, wherein a thickness of the core portion is 50 μm or more and 300 μm or less.

7. The zinc foil according to claim 1, wherein a thickness of the cladding portion is 1 μm or more and less than 200 μm.

8. The zinc foil according to claim 1, wherein the zinc foil has an elongation after fracture of 8% or more, wherein the elongation is measured at a tensile speed of 1 mm/min with a distance between chucks of 30 mm and a specimen width of 45 mm.

9. The zinc foil according to claim 3, wherein the average zinc crystal grain size in the core portion is 24 μm or more and 100 μm or less.

10. The zinc foil according to claim 2, wherein a bismuth content in the cladding portion is 100 ppm or more and 10,000 ppm or less.

11. The zinc foil according to claim 2, wherein a thickness of the core portion is 50 μm or more and 300 μm or less.

12. The zinc foil according to claim 2, wherein a thickness of the cladding portion is 1 μm or more and less than 200 μm.

13. The zinc foil according to claim 2, wherein the zinc foil has an elongation after fracture of 8% or more, wherein the elongation is measured at a tensile speed of 1 mm/min with a distance between chucks of 30 mm and a specimen width of 45 mm.

14. A method for producing the zinc foil according to claim 1, the method comprising:

forming a layer, containing zinc as a base metal and containing bismuth, on at least one side of a rolled zinc foil by employing a thin-film forming means, the rolled zinc foil containing zinc as a base metal and containing substantially no bismuth.

15. The method for producing the zinc foil according to claim 14, wherein the thin-film forming means is electrolytic plating on at least one side of the rolled zinc foil using the rolled zinc foil as a cathode and using an electrolyte solution containing zinc ions and bismuth ions.

* * * * *